United States Patent [19]

Gobush

[11] Patent Number: 4,765,626

[45] Date of Patent: Aug. 23, 1988

[54] GOLF BALL

[75] Inventor: William Gobush, Dartmouth, Mass.

[73] Assignee: Acushnet Company, New Bedford, Mass.

[21] Appl. No.: 58,329

[22] Filed: Jun. 4, 1987

[51] Int. Cl.[4] ..... A63B 37/14

[52] U.S. Cl. ..... 273/232

[58] Field of Search ..... 273/232, 233, 213; 40/327, 235 R, 62

[56] References Cited

U.S. PATENT DOCUMENTS 4,560,168 12/1985 Aoyama ..... 273/232

FOREIGN PATENT DOCUMENTS 377354 7/1932 United Kingdom ..... 273/232

*Primary Examiner*—George J. Marlo

*Attorney, Agent, or Firm*—Lucas & Just

[57] ABSTRACT

A golf ball having dimples covering its surface, and having three great circular paths on the surface of the golf ball where none of the paths intersect a dimple is disclosed. The three great circular paths are obtained by laying out a truncated octahedron on the surface of the golf ball and dividing the six square faces into four equal isosceles triangles. The great circular paths are coextensive with the bisecting lines. Golf balls having 368 and 632 dimples and having three great circles are disclosed.

13 Claims, 6 Drawing Sheets

GOLF BALL

The present invention relates to golf balls and, more particularly, to golf balls having three parting lines and dimples evenly and uniformly distributed over the surface of the ball so that the dimple pattern, on one side of a parting line, is a mirror image of the dimple pattern on the other side of the parting line.

Typically, golf balls are made in a molding process that imparts a single mold parting line on the ball. Attempts have been made to increase the number of parting lines on a golf ball by adding so-called false parting lines. However, such attempts have produced large, bald spots or parting lines that intersect dimples. Both of these outcomes are undesirable. A recent attempt, U.S. Pat. No. 4,560,168, describes a golf ball with six parting lines and dimple patterns which do not form mirror images along the parting lines. In the '168 patent, the dimples are arranged on the surface of a golf ball by first dividing the spherical surface of the golf ball into twenty triangular sections corresponding to a regular icosahedron, and then subdividing each triangle so formed into four smaller triangles. Those smaller triangles are formed by joining the midpoints of each of the icosahedron triangles. The parting lines are coextensive with the lines that join the midpoints. Such a pattern produces an uneven or non-mirror image dimple pattern along any given parting line, as is clearly evident from the description and drawings of the '168 patent.

Generally, golfers prefer a mirror image dimple pattern along the parting line because they often use the parting line to align their shots, and a mirror image dimple pattern along the parting line provides a visual balance. A non-mirror image dimple pattern along the parting line provides a visual unevenness and can ruin the golfer's shot. The present invention overcomes these disadvantages as well as others.

The present invention provides a golf ball with three parting lines which correspond to three great circular paths that encircle the golf ball, where none of the parting lines intersect any of the dimples, and where the dimple pattern, on one side of the parting line, is a mirror image of the dimple pattern on the other side of the parting line.

The dimple pattern of the present invention is obtained by dividing the spherical surface of a golf ball into eight substantially identical hexagons and twenty-four substantially identical isosceles triangles, and then arranging dimples inside the hexagons and the isosceles triangles. The eight hexagons are located on the surface of the golf ball by first inscribing a truncated octahedron inside the surface of a golf ball. The eight hexagons correspond to the eight hexagons of the truncated octahedron. The isosceles triangles are located by quartering the square faces of the truncated octahedron. The square faces of the truncated octahedron are quartered by bisecting each square face twice. The bisecting of each square face is accomplished by connecting opposite corners of the square to form four isosceles triangles in each square. Dimples are arranged inside of each hexagon and inside of each isosceles triangle of the square faces. The three great circular paths correspond to the three perpendicular planes that contain the bisecting lines of the square faces of the truncated octahedron. The three parting lines correspond to the three great circular paths. Preferably, the mold parting line corresponds to one of the parting lines of the present invention while the other two parting lines are false parting lines.

A truncated octahedron is a fourteen-sided figure with eight sides being hexagons and six sides being squares. Each hexagon has substantially equal sides and substantially equal angles between sides.

Dimples are arranged evenly and uniformly distributed over the surface of a golf ball by arranging dimples inside each hexagon and inside each isosceles triangle. The dimples may be of any size, shape, and number to include patterns with multiple diameter dimples. Preferably, at least about 50% of the surface of the golf ball is covered with dimples.

Dimple patterns having 368 or 632 dimples are preferably used. Some manufacturers remove a small number of dimples, typically eight, four at each pole, so that a trademark and identification number can be affixed to the ball. However, modern stamping methods allow for affixing trademarks and identification numbers without the removal of dimples.

In order to obtain a substantial mirror image dimple pattern along each of the parting lines, the dimple pattern in each of the hexagons is substantially identical, and the dimple pattern in each of the isosceles triangles is substantially identical.

Additionally, a golf ball made in accordance with the present invention produces a golf ball with less fret area and higher ratio of dimpled area to total surface area.

These and other aspects of the present invention may be more fully understood with reference to the accompanying drawings wherein.

Figure 1:
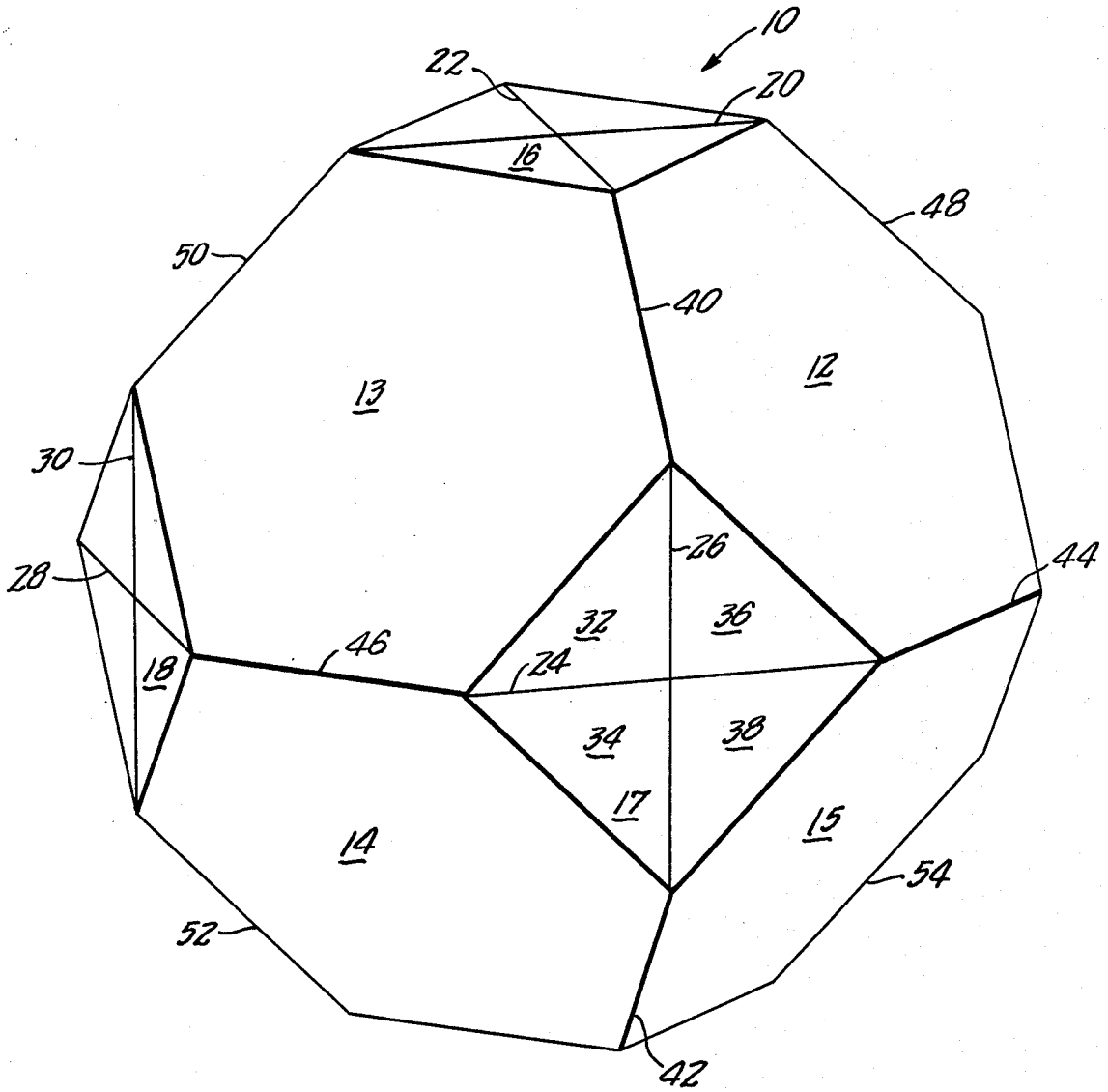
FIG. 1 illustrates a truncated octahedron.

FIG. 1 illustrates truncated octahedron 10 having hexagonal faces 12, 13, 14, and 15 and square faces 16, 17, and 18. Face 16 is bisected by lines 20 and 22. Face 17 is bisected by lines 24 and 26, and face 18 is bisected by lines 28 and 30. These bisecting lines quarter each square face and form four substantially identical isosceles triangles. For example, square face 17 has four isosceles triangles labeled 32, 34, 36, and 38. One great circular path is coextensive with bisecting lines 26 and 22 as well as edges 40 and 42. A second great circular path is coextensive with bisecting lines 24 and 28 and edges 44 and 46. A third great circular path is coextensive with bisecting lines 20 and 30 and edges 48, 50, 52, and 54.

Each hexagonal face is substantially identical to each other. Each hexagonal face has substantially identical sides and substantially identical angles between sides. Each square face is substantially identical. Each square face has substantially identical sides and substantially identical angles.

Figure 2:
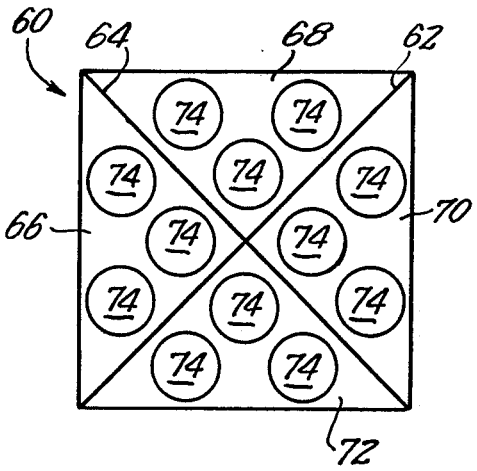
FIG. 2 illustrates a preferred square face of a truncated octahedron isosceles triangle, which has been quartered into four, having a dimple pattern for a golf ball with 368 dimples made in accordance with the present invention.
Figure 3:
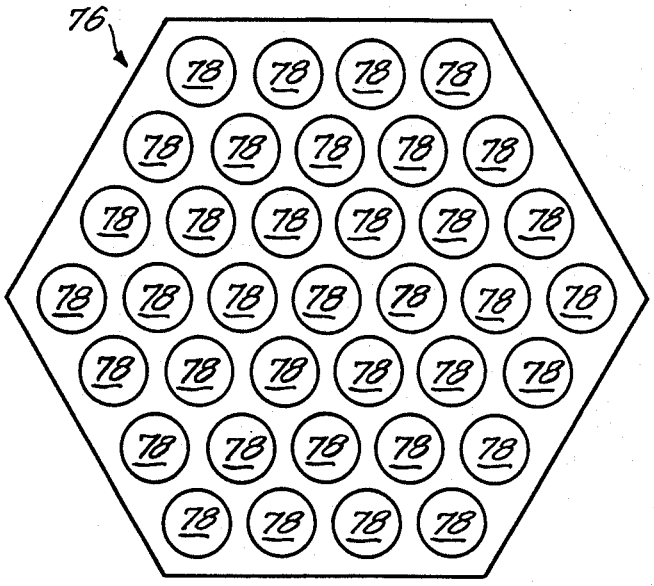
FIG. 3 illustrates a preferred hexagonal face of a truncated octahedron having a dimple pattern for a golf ball with 368 dimples made in accordance with the present invention.

FIGS. 2 and 3 illustrate a dimple pattern of a square and a hexagon used to make a golf ball with 368 dimples in accordance with the present invention. FIG. 2 illustrates a square face 60 bisected by lines 62 and 64 to form four isosceles triangles 66, 68, 70 and 72 having dimples 74 arranged therein. FIG. 3 illustrates hexagon 76 with dimples 78 arranged therein.

Dimple 74 has a maximum diameter of about 0.149 inches, and dimple 78 has a maximum diameter of about 0.154 inches. In order to obtain maximum dimple area coverage on the surface of the golf ball, dimple 74 has a dimple diameter of about 0.149 inches and dimple 78 has a dimple diameter of about 0.154 inches. With these two dimple diameters, the dimpled surface area coverage is about 76.3%. Preferably, dimples 74 and 78, in a single dimple size configuration, have a dimple diameter in the range of about 0.14 inches to about 0.15 inches. Using the dimple arrangement of FIGS. 2 and 3, a golf ball made in accordance with the present invention is prepared with a total of 368 dimples.

Figure 4:
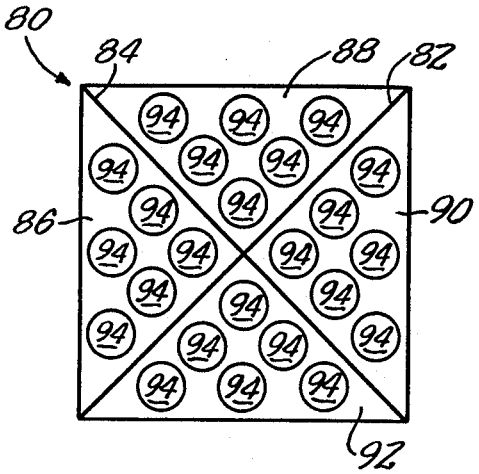
FIG. 4 illustrates a preferred square face of a truncated octahedron which has been quartered into four isosceles triangles having a dimple pattern for a golf ball with 632 dimples made in accordance with the present invention.
Figure 5:
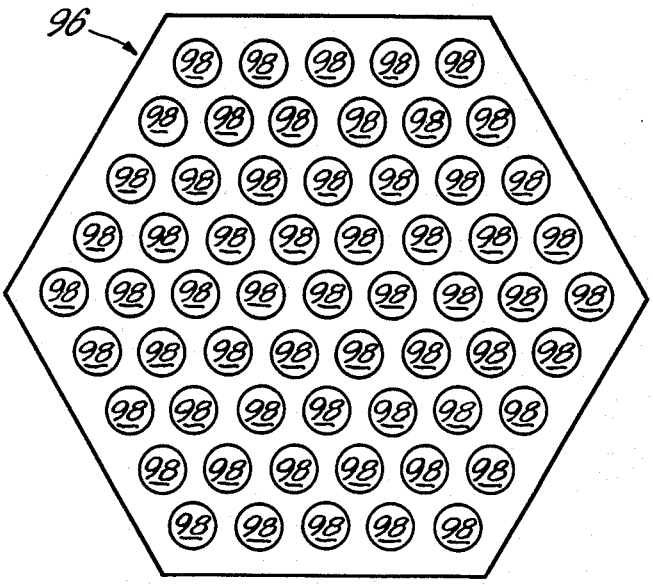
FIG. 5 illustrates a preferred hexagonal face of a truncated octahedron having a dimple pattern for a golf ball with 632 dimples made in accordance with the present invention.

FIGS. 4 and 5 illustrate a dimple pattern of a square and a hexagon for making a golf ball in accordance with the present invention, having a dimple pattern with 632 dimples.

FIG. 4 illustrates a square face 80 bisected by lines 82 and 84 to form four isosceles triangles 86, 88, 90 and 92, having dimples 94 arranged therein. FIG. 5 illustrates hexagon 96 with dimples 98 arranged therein.

Dimples 94 have a maximum diameter of about 0.114 inches, and dimples 98 have a maximum diameter of about 0.120 inches. In order to obtain maximum dimple area coverage on the surface of a golf ball, dimples 94 have a dimple diameter of about 0.114 inches, and dimples 98 have a dimple diameter of about 0.120 inches. With these two dimple diameters, the dimpled surface area coverage is about 78.8%. Preferably, dimples 74 and 98, in a single dimple size configuration, have a dimple diameter in the range of about 0.10 inches to about 0.115 inches. Using the dimple arrangement of FIGS. 4 and 5, a golf ball made in accordance with the present invention is made having a total of 632 dimples.

Figure 6:
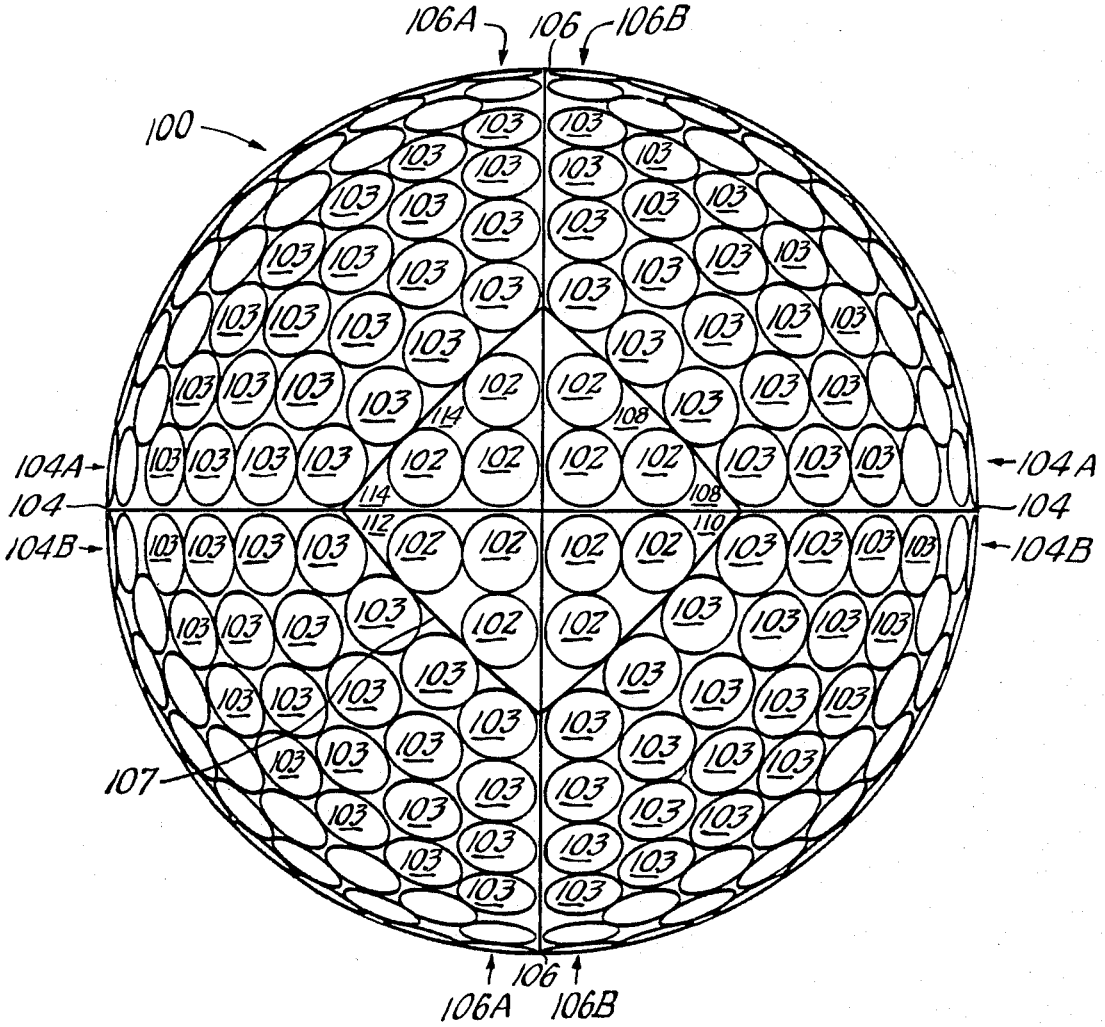
FIGS. 6 and 6A illustrate a projected golf ball having 368 dimples in accordance with the present invention; and, FIGS. 7 and 7A illustrate a projected golf ball having 632 dimples in accordance with the present invention.

FIG. 6 is a projected view of golf ball 100. Dimples 102 and 103 are arranged thereon using the dimple pattern of FIGS. 2 and 3. Dimples 102 are substantially uniform in diameter and have a diameter of about 0.149 inches. Dimples 103 are substantially uniform in diameter and have a diameter of about 0.154 inches. Great circular paths 104 and 106 are shown. Square face 107 has been divided into four isosceles triangles similar to the one shown in FIG. 2 and labeled 108, 110, 112 and 114. Such a golf ball has 368 dimples.

The mirror image dimple pattern of the present invention is illustrated along great circular paths 104 and 106. The dimples in row 104A substantially mirror those dimples in row 104B, and the dimples in column 106A substantially mirror the dimples in column 106B.

It is also readily apparent that the dimple pattern in triangle 108 is a substantial mirror image of the dimple pattern in triangle 110 and that the dimple pattern in triangle 114 is a substantial mirror image of the dimple pattern in triangle 108. Such a mirror image exists along each of the great circular paths.

Figure 6A:
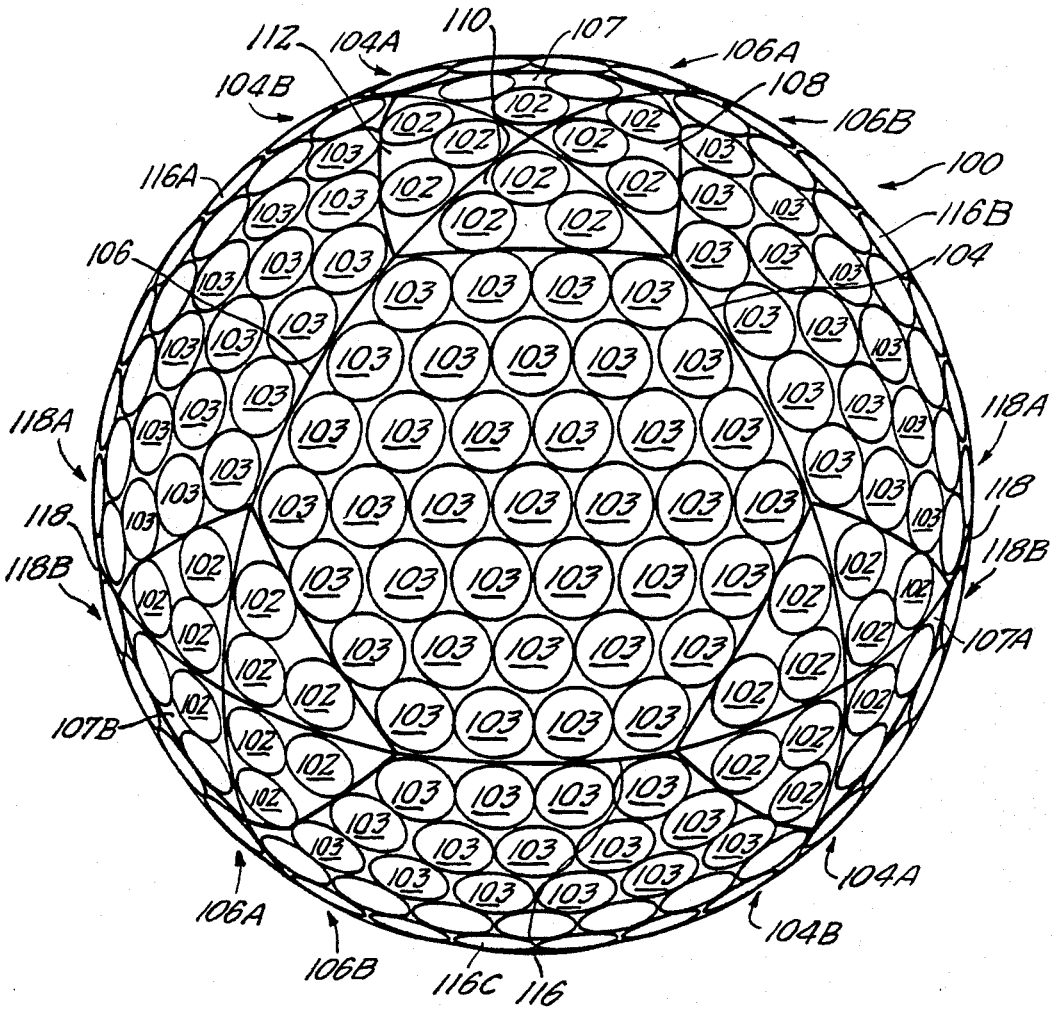

FIG. 6A illustrates a projected view of golf ball 100 from FIG. 6, rotated about 90° into the plane of the paper. Isosceles triangles 108, 110 and 112 are located at the top of golf ball 100 in FIG. 6A. Also evident in FIG. 6A is great circular path 104 and 106 and dimple rows 104A, 104B, 106A and 106B. Hexagonal face 116 is surrounded by hexagonal faces 116A, 116B and 116C as well as square faces 107, 107A and 107B. The third great circular path 118 is illustrated.

The mirror image dimple pattern of the present invention is clearly evident by comparing the dimples in row 118A with the dimples in row 118B. It is also readily apparent that the dimple pattern in hexagonal face 116 is substantially identical to the dimple pattern in hexagonal faces 116A, 116B and 116C, thus further illustrating the substantial mirror image effect of the present invention.

Another novel aspect of the present invention is the superior packing of dimples. As can be seen in FIG. 6A, the dimples in hexagonal face 116 have 6 neighboring dimples. Each dimple center has 6 neighboring dimple centers that are uniformly spaced from each other. This allows for a high ratio of dimpled surface area to total surface area of the golf ball in this invention.

The golf ball of FIGS. 6 and 6A has 368 dimples with a dimpled surface area coverage of about 76.3%.

Figure 7:
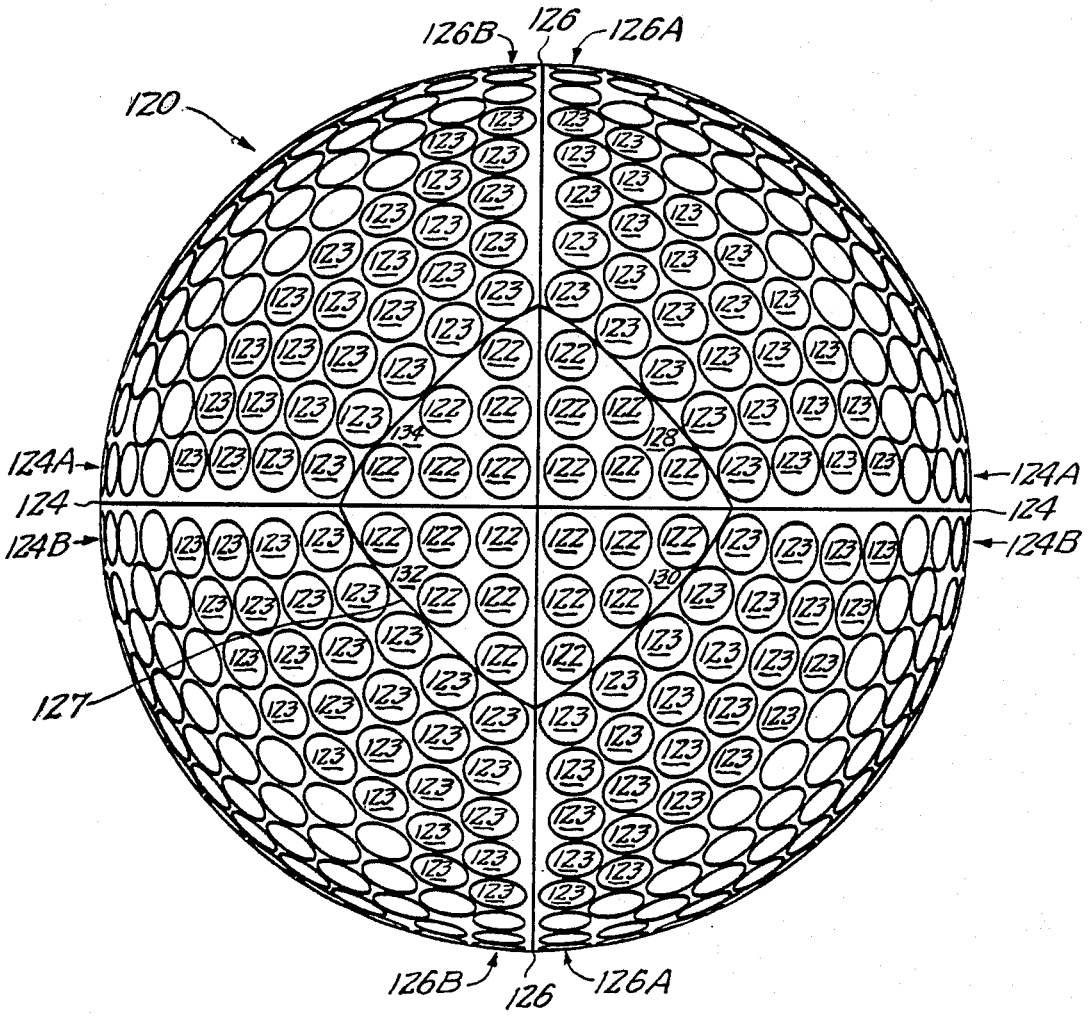

FIG. 7 is a projected view of golf ball 120 with dimples 122 and 123 arranged therein using the patterns of FIGS. 4 and 5. Dimples 122 in a square region are substantially uniform in diameter and have a diameter of about 0.10 inches. Dimples 123 are substantially uniform in diameter and have a diameter of about 0.11 inches. Great circular paths 124 and 126 are shown. Square 127 is divided into four isosceles triangles, 128, 130, 132 and 134.

The mirror image dimple pattern of the present invention is illustrated along great circular paths 124 and 126. The dimples in row 126A substantially mirror the dimples in row 126B, and the dimples in column 124A substantially mirror the dimples in column 124B.

It is also readily apparent that the dimple pattern in triangle 128 is a substantial mirror image of the dimple pattern in triangle 130 and that the dimple pattern in triangle 134 is a substantial mirror image of the dimple pattern in triangle 128. Such a mirror image exists along each of the great circular paths.

Figure 7A:
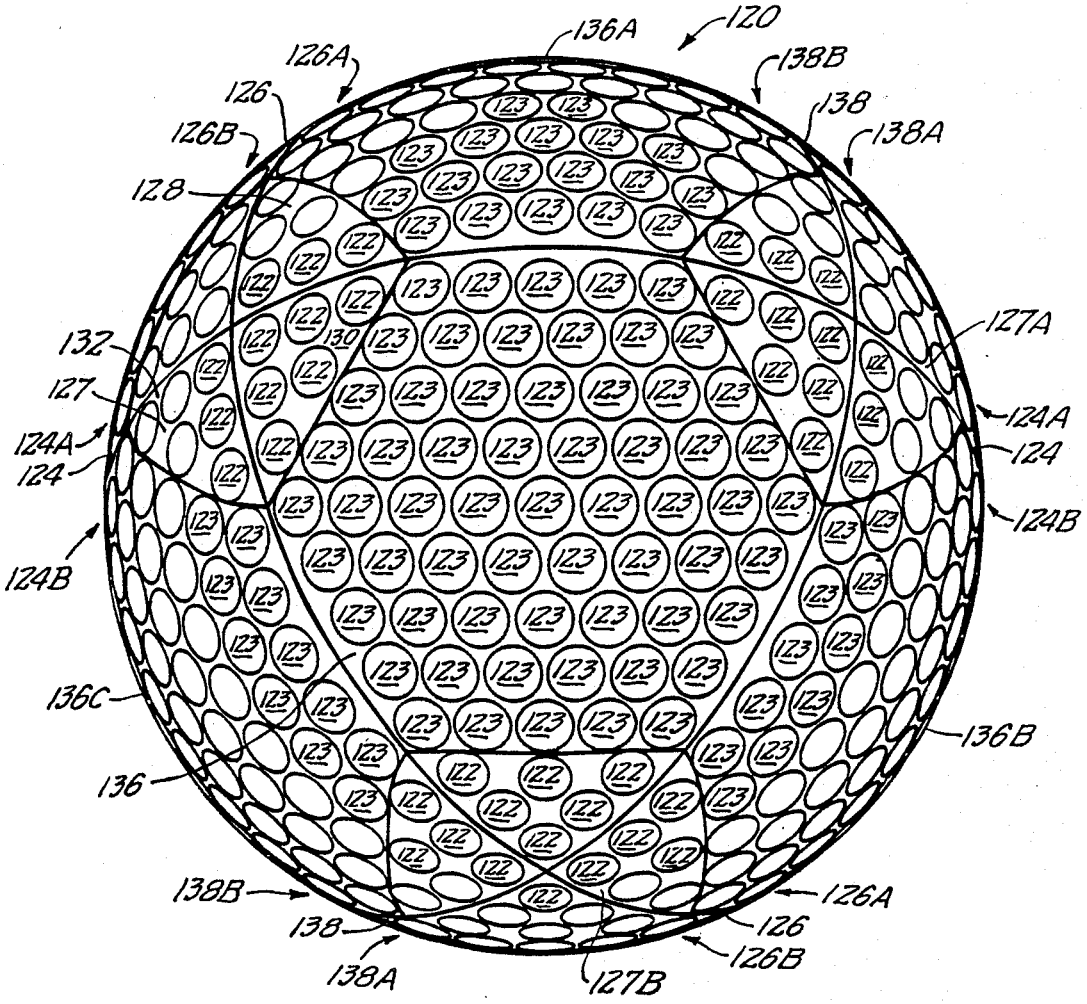

FIG. 7A illustrates a projected view of golf ball 120 from FIG. 7, rotated by about 90° into the plane of the paper. Isosceles triangles 128, 130 and 132 are located at the top left corner of golf ball 120 in FIG. 7A. Also evident in FIG. 7A is great circular paths 124 and 126 and dimple rows 124A, 124B, 126A and 126B. Hexagonal face 136 is surrounded by hexagonal faces 136A, 136B and 136C, as well as square faces 127, 127A and 127B. The third great circular path 138 is illustrated.

The mirror image dimple pattern of the present invention is clearly evident by comparing the dimples in row 138A with the dimples in row 138B. It is also readily apparent that the dimple pattern in hexagonal face 136 is substantially identical to the dimple pattern in hexagonal faces 136A, 136B and 136C. This further illustrates the mirror image of the present invention.

It can also be seen in FIG. 7A that the present invention provides superior packing of dimples. In hexagonal face 136, each dimple center of dimples 123 has 6 neighboring dimples with centers that are uniformly spaced from each other. This allows for a high ratio of dimpled surface area to total surface area of the golf ball in this invention.

The golf ball of FIGS. 7 and 7A has 632 dimples and a dimpled surface area coverage of about 65.1%.

For any number appearing in the claims which is not modified by the term "about", it will be understood that the term "about" modifies such number.

A dimple, as used in the specification and claims and as used in the golf industry, is a standard term well known to those of skill in the art.

When referring to a dimple diameter, the term "diameter" as used herein, means the diameter of a circle defined by the edges of the dimple. When the edges of a dimple are non-circular, the diameter means the diameter of a circle which has the same area as the area defined by the edges of the dimple. When the term "depth" is used herein, it is defined as the distance from the continuation of the periphery line of the surface of the golf ball to the deepest part of a dimple which is a section of a sphere. When the dimple is not a section of a sphere, the depth, in accordance with the present invention, is computed by taking a cross section of the dimple at its widest point. The area of the cross section is computed and then a section of a circle, of equal area, is substituted for the cross section. The depth is the distance from the continuation of the periphery line to the deepest part of the section of the circle.

It will be understood that the claims are intended to cover all changes and modifications of the preferred embodiment of the invention herein chosen for the purpose of illustration, which do not constitute a departure from the spirit and scope of the invention.

What is claimed is:

1. A golf ball having a spherical surface with a plurality of dimples formed thereon, and three parting lines which do not intersect any dimples, the dimples being arranged by dividing the spherical surface into eight hexagons and twenty-four isosceles triangles, the eight hexagons and twenty-four isosceles triangles being formed by inscribing a truncated octahedron in said spherical surface, said eight hexagons corresponding to the eight hexagons of the truncated octahedron, the twenty-four isosceles triangles corresponding to the twenty-four isosceles triangles formed by bisecting the six square faces of the truncated cuboctahedron; said three parting lines corresponding to the bisecting lines of the six square faces; said dimples being arranged in said twenty-four isosceles triangles so that they do not intersect any parting line.

2. The golf ball of claim 1 wherein each isosceles triangle has a substantially similar dimple pattern.

3. The golf ball of claim 1 wherein each isosceles triangle has a substantially similar dimple pattern, and each hexagon has a substantially similar dimple pattern.

4. The golf ball of claim 1 wherein the total number of dimples is 368.

5. The golf ball of claim 1 wherein the total number of dimples is 632.

6. The golf ball of claim 1 wherein the dimples have at least two different diameters.

7. A golf ball having a spherical surface with a plurality of dimples thereon and three great circular paths which do not intersect any dimples, the circular paths being arranged on the spherical surface by inscribing a truncated octahedron in said spherical surface, and bisecting the square faces of said truncated octahedron twice to form twenty-four isosceles triangles; the great circular paths corresponding to the bisecting lines of each square face; the dimples being arranged in said isosceles triangles and in the hexagonal faces of said truncated octahedron so that they do not intersect the bisecting lines.

8. The golf ball of claim 7 wherein each isosceles triangle has a substantially similar dimple pattern.

9. The golf ball of claim 7 wherein each isosceles triangle has a substantially similar dimple pattern and each hexagon has a substantially similar dimple pattern.

10. The golf ball of claim 7 wherein the total number of dimples is 368.

11. The golf ball of claim 7 wherein the total number of dimples is 632.

12. The golf ball of claim 7 wherein the dimples have at least two different diameters.

13. A golf ball having a spherical surface with a plurality of dimples thereon, and three parting lines which do not intersect any dimples, said parting lines corresponding to circular paths which coextend with twelve bisecting lines, said bisecting lines corresponding to lines which bisect square faces of a truncated octahedron inscribed in said spherical surface, said lines forming twenty-four isosceles triangles; said dimples being arranged in said twenty-four isosceles triangles so that they do not intersect the parting lines.

* * * * *

UNITED STATES PATENT AND TRADEMARK OFFICE

CERTIFICATE OF CORRECTION

PATENT NO. : 4,765,626

DATED : August 23, 1988

INVENTOR(S) : William Gobush

It is certified that error appears in the above-identified patent and that said Letters Patent are hereby corrected as shown below:

Column 5, line 46, change "cuboctahedron" to --octahedron--.

Column 6, line 13, change "diameters" to --sizes--.

Column 6, line 37, change "diameters" to --sizes--.

Signed and Sealed this

Twenty-first Day of March, 1989

*Attest:*

DONALD J. QUIGG

*Attesting Officer*

*Commissioner of Patents and Trademarks*